United States Patent [19]

Löbbe et al.

[11] 4,243,268

[45] Jan. 6, 1981

[54] MINERAL MINING INSTALLATION WITH PLANER AND JET CARRIER

[75] Inventors: Armin Löbbe, Oberaden; Hans-Th. Grisebach, Unna, both of Fed. Rep. of Germany

[73] Assignee: Gewerkschaft Eisenhutte Westfalia, Lunen, Fed. Rep. of Germany

[21] Appl. No.: 959,864

[22] Filed: Nov. 13, 1978

[30] Foreign Application Priority Data

Nov. 19, 1977 [DE] Fed. Rep. of Germany ..... 2751790

[51] Int. Cl.[3] ..... E21C 27/18

[52] U.S. Cl. ..... 299/32; 299/17; 299/34; 299/81

[58] Field of Search ..... 299/17, 32, 34, 43, 299/81, 33; 175/67

[56] References Cited

U.S. PATENT DOCUMENTS

| | | | |
|---|---|---|---|
| 3,306,665 | 2/1967 | Lobbe | 299/34 |
| 3,887,235 | 6/1975 | Koppers | 299/43 X |

FOREIGN PATENT DOCUMENTS

| | | | |
|---|---|---|---|
| 672336 | 5/1952 | United Kingdom | 299/17 |
| 1091844 | 5/1964 | United Kingdom . | |
| 1426854 | 3/1976 | United Kingdom . | |
| 1481198 | 7/1977 | United Kingdom . | |
| 1490351 | 11/1977 | United Kingdom . | |

*Primary Examiner*—Ernest R. Purser

*Attorney, Agent, or Firm*—Thompson, Birch, Gauthier & Samuels

[57] ABSTRACT

A mineral, e.g., coal, mining installation employs a winning machine, such as a plough, equipped with cutting means and which is moved back and forth along a mineral or coal face and along a scraper-chain conveyor as is known per se. Roof support units are arranged along the goaf side of the conveyor and employ roof bars projecting across the roof of the working towards the mineral face. Shifting rams are provided to alternately advance the conveyor and the roof support units as the winning work progresses. The roof bars of the units are pivotably connected to forwardly-projecting components which act as carriers for swinging nozzles emitting high-pressure water jets which impinge on the face to create a channel at the roof zone thereof. The position of the channel can be adjusted by pivoting the carriers with the aid of hydraulic devices. Further swinging nozzles are located at the floor region, conveniently in a frame supporting the conveyor, and these further nozzles emit further water jets which create a channel at the floor zone of the mineral face.

13 Claims, 2 Drawing Figures

FIG. 1
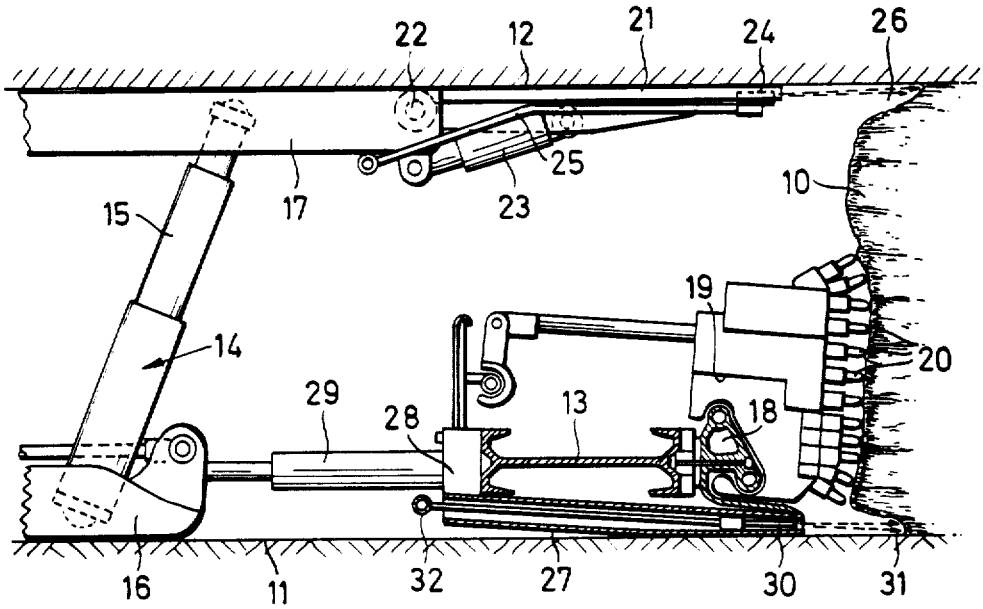
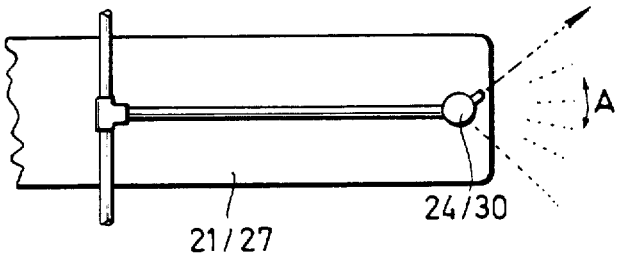
FIG. 2

MINERAL MINING INSTALLATION WITH PLANER AND JET CARRIER

BACKGROUND OF THE INVENTION

The present invention relates to installations for winning mineral, especially coal.

In mechanized workings, it is well known to utilize a machine, such as a shearer or plough, which is moved back and forth along a mineral or coal face to strip mineral therefrom with mechanical cutting tools. The mineral is transported away with a scraper-chain conveyor and conveniently the winning machine is mounted on guide means at the mineral face side of the conveyor. The conveyor is shifted up towards the face from time to time with the aid of shifting rams connected between the conveyor and roof support chocks arranged at the goaf side of the conveyor.

Apparatus has been described which serves to win coal by hydraulic pressure. German patent specification No. 2307413 describes apparatus wherein high-pressure water nozzles are carried by the roof support units or on a special plough so that coal is removed from the face solely by high-pressure water jets. U.K. patent specification No. 672336 describes a coal cutting machine which employs both mechanical cutting tools and high pressure nozzles so that coal is won by a combination of mechanical and hydraulic methods.

Difficulties can arise where the nozzles are provided on the cutting machine itself and prior art apparatus has not been able to provide efficient working of the coal face. A general object of the present invention is to provide an improved mining installation, enabling mineral to be won by a combination of mechanical and hydraulic methods in a particularly efficient manner.

SUMMARY OF THE INVENTION

In accordance with the present invention, a plough or winning machine serves to strip the mineral from the face solely by mechanical cutting means and additional high pressure fluid emitting nozzles are arranged to act solely on the roof and/or floor regions of the face without affecting the winning work performed by the machine. Preferably, the jets emitted by the nozzles act to create channels in the roof or floor regions of the mineral face or, more preferably, in both these regions.

It is preferable to arrange the nozzles on carrier means which can be displaced towards the face to follow up the winning progress. The carrier means for the nozzles can take a variety of forms. In one practical embodiment, the roof bars of support units or chocks have forwardly-projecting components acting as the carrier means. An analogous arrangement can be provided for the floor sills of the support units. Other forms of carrier means are the guide for the machine of the pans of the conveyor. In another design, a floor frame supporting the conveyor can act as a carrier for floor region nozzles.

The channel or channels cut in the face by the fluid jets assists the work performed by the machine or plough, relieves stresses and avoids the problems involved in cutting away the face at the junctures with the roof and floor rock. The machine or plough can hence have a minimal height and this assists in the overall guidance of the machine or plough. In addition, by creating a floor channel with the fluid jets, a location for guidance purposes can be provided for the machine or plough.

Where the roof nozzles are provided on carriers linked to the roof bars of support units, it is advantageous to make the carriers pivotable so that by raising and lowering the carriers, the position of the channel in the roof region of the face can be adjusted or a series of parallel roof region channels can be produced.

Normally, the nozzles would be fed with high pressure water and since only the roof and/or floor regions are subjected to the water jets, the quantity of water needed is comparatively small. The water is also advantageous in suppressing dust produced as the machine performs its winning work. In general, the water or other high pressure fluid would be at a pressure of at least 500 bars and, more preferably, 700–1000 bars.

It is desirable to make the individual nozzles positionally adjustable. The nozzles may pivot horizontally and/or vertically and preferably perform a reciprocal pivotal movement automatically when supplied with the pressure fluid. By making the carrier means for the nozzles also positionally displaceable, the nozzles can be accurately directed to the desired zones of the floor and roof regions of the face.

It is preferable to provide control means for the supply of high-pressure fluid to the nozzles which acts so that the nozzles are only effective in emitting their fluid jets when the carrier means thereof is advanced towards the face. Otherwise, the control means ensures the jets are automatically disabled.

To provide for easy replacement, the nozzles are preferably removable from their carrier means towards the goaf or stowage zone of the mine working.

The invention may be understood more readily, and various other features of the invention may become apparent, from consideration of the following description.

BRIEF DESCRIPTION OF DRAWING

An embodiment of the invention will now be described, by way of example only, with reference to the accompanying drawing, wherein:

FIG. 1 is a schematic cross-sectional view of a mineral winning installation made in accordance with the invention; and FIG. 2 is a schematic plan view of part of the installation shown in FIG. 1.

DESCRIPTION OF PREFERRED EMBODIMENT

As shown in FIG. 1, an underground mine working has a mineral, e.g., coal, face 10, a floor 11 and a roof 12. A scraper-chain conveyor 13 is located in front of the face 10. The conveyor 13 is composed of individual channel sections or pans joined end-to-end in known manner. At the goaf side of the conveyor 13, support chocks or units are provided. In the illustrated embodiment, each support unit 14 comprises one or more hydraulic props 15 which rest on floor sill structures 16 engaging on the floor 11 and the prop(s) 15 carry one or more roof bars 17 braced against the roof 12, as shown. The bars 17 can be raised or lowered. The units 14 are effectively coupled to the conveyor 13 via shifting rams 29, as described in more detail hereinafter.

On the coal face side of the conveyor 13, a ramp-like guide means 18 is provided. A winning machine in the form of a plough 19 is guided for movement back and forth along the guide means 18. The plough 19 is driven by means of an endless chain (not shown) located within guide channels in the guide means 18. The plough 19 is equipped with cutter bits or tools 20 located one above another in staggered positions in known manner. The cutters 20 strip coal from the face 10 as the plough 19 is driven back and forth. As shown, the plough 19 has an arm extending across the conveyor to slidably engage on a further guide at the goaf side of the conveyor 13.

The roof bars 17 of the units 14 are pivotably connected to carriers 21 projecting forwardly across the conveyor 13 towards the face 10. Hydraulic piston and cylinder units 23 are connected between the bars 17 and the carriers 21 to enable the carriers 21 to be pivoted up and down. At the front end of the carriers 21, high pressure fluid or water nozzles 24 are provided. The nozzles 24 can be swivelled in relation to the carriers 21 in a direction parallel to the face 10. Conduits or hoses 25 extend beneath the lower side of the bars 17 and the carriers 21 and feed fluid, usually water, to the nozzles 24 at a pressure of 700 bars or more. The nozzles 24 are arranged so as to direct a high pressure fluid jet against the face 10, thereby to cut a channel 26 at the roof region of the face 10. The roof level of the face 10 is thus relieved. When the high pressure fluid is water, as is preferred, the face 10 is saturated with water. The water discharged by the nozzles 24 also serves to suppress the dust arising when the face 10 is cut-away by the plough 19. By pivoting the carriers 21 downwardly with the aid of the units 23, the nozzles 24 can be directed on at lower levels of the face 10 below the roof level and a series of channels 26 can be produced.

The conveyor 13 rests on a support frame 27 which in a similar manner to the conveyor 13, can be made up from individual sections joined end-to-end. The frame 27 has brackets 28 connected to the cylinders of the shifting rams 29. The piston rods of the rams 29 are linked to the floor sill structures 16 of the units 14. In known manner, the rams 29 are operated to alternately shift the individual units 14 on the one hand and the conveyor 13 with the guide means 18 and the plough 19 on the other hand. The frame 27 is hollow and is provided at the coal face side with nozzles 30, again discharging high pressure fluid or water and again pivotably along the face 10.

The nozzles 30 are protected and are preferably retractible within the frame 27 and are arranged to cut a channel 31 at the floor region of the face 10. One or more hoses or conduits 32 feed fluid or water to the nozzles 30 and a common pump source or separate sources can feed the hoses 32,25.

The hydraulically-formed channels 31,26 assists the mechanical winning of the coal or mineral with the cutters 20 of the plough 19. The floor channel 31 can also locate and control the cutting path of the plough 19. The cutting of the channel 31 with the fluid jets thus performs the function hitherto performed by mechanical floor cutters of the plough 19 and the entire plough system can be controlled in otherwise known manner to cause the plough 19 to rise or fall in its passage along the face 10. The floor channel 31 may also form a direct location for the guide means 18 or the frame 27 when the conveyor 13 is shifted up to thereby stabilize the installation. Likewise, the roof channel 26 can form a direct location for the carriers 21 and hence the roof bars 17 when the units 14 are advanced.

FIG. 2 shows a single high pressure nozzle 24/30 mounted on its associated carrier 21/27. The nozzle 24/30 is pivotable in the direction of arrows A and during operation, the nozzle 24/30 pivots back and forth in reciprocal manner, as previously mentioned.

It is desirable to provide control means which ensures that the high pressure fluid is only fed to the nozzles 24,30 at the roof and floor when the respective carriers 21,27 are being advanced towards the face 10. Normally, the appropriate section of the conveyor 13 would be advanced by its associated ram 29 prior to drawing up of the associated unit 14. Hence, the floor channel 31 would be produced over the corresponding region of the face 10 before the roof channel 26.

Although in the illustrated embodiment the frame 27 constituting the carrier for the nozzle 30 is essentially fixed in relation to the floor 11, other than for shifting purposes, it is possible to make the frame 27 tilt in a vertical plane. By tilting the frame 27, the nozzles 30 can be directed at different levels in an analogous manner to the way in which the carriers 21 and nozzles 24 are tilted by the units 23. The conveyor 13 and hence the guide means 18 would also be tilted with the frame 27. In order to tilt the frame 27, a series of hydraulic lifting jacks (not shown) can be provided.

In one modification of the illustrated embodiment, the lower floor nozzles 30 are arranged on the floor sill structures 16 of the units 14. In this case, the floor sill structures 16 have forwardly-extending regions projecting beneath the conveyor 13. The frame 27 would be omitted so that the conveyor 13 is supported on the forward regions of the structures 16.

In another modification of the illustrated embodiment, the nozzles 30 are arranged on the guide means 18 of the conveyor pans, instead of the frame 27.

We claim:

1. In a mineral mining installation wherein a mineral winning machine is guided by guide means for movement in a mine working along a mineral face to strip mineral therefrom with the aid of cutters; the improvement comprising carrier means movably interconnected with said guide means for displacement in relation to the mineral face independently of said guide means and said winning machine, and high-pressure fluid nozzles supported on said carrier means, said nozzles emitting high pressure fluid jets capable of producing a channel in an area of the mineral face other than the area being stripped by said cutters.

2. An installation according to claim 1, wherein the carrier means is arranged at the region of the mineral face adjacent the roof of the mine working and the channel is produced at the roof region of the mineral face.

3. An installation according to claim 2 and further comprising roof support units, each having a floor-sill structure for resting on the floor of the mine working, at least one roof engaging member and at least one hydraulic prop between the floor-sill structure and the roof-engaging member; wherein the carrier means comprises individual carriers connected to the roof-engaging members of said support units.

4. An installation according to claim 3, wherein the carriers are pivotably connected to their associated roof engaging members to move therewith towards the mineral face and a hydraulic piston and cylinder unit is connected between each carrier and its associated roof engaging member and serves to pivot the carrier in respect of the roof engaging member to raise and lower the carrier.

5. An installation according to claim 1, and further comprising roof support units, each having a floor-sill structure for resting on the floor of the mine working, at least one roof engaging member and at least one hydraulic prop between the floor-sill structure and the roof-engaging member; wherein the carrier means is constituted, at least in part, by the floor-sill structures of said support units.

6. An installation according to claim 2, wherein an additional carrier means is arranged at the region of the mineral face adjacent the floor of the mine working and the channel is produced at the floor region of the mineral face.

7. An installation according to claim 6, and further comprising a scraper-chain conveyor extending alongside the mineral face and a frame resting on the floor of the mine working and supporting the conveyor; wherein the additional means is constituted, at least in part, by the frame.

8. An installation according to claim 1, wherein the high pressure fluid jets are selectively operable when the carrier means therefor is displaced towards the mineral face.

9. An installation according to claim 1, wherein the nozzles are positionally adjustable.

10. An installation according to claim 1, wherein the nozzles are pivotable in a horizontal plane.

11. An installation according to claim 1, wherein the carrier means is displaceable towards the mineral face and is raisable and lowerable.

12. A mineral mining installation comprising a scraper-chain conveyor extending alongside a mineral face, guide means at the mineral face side of the conveyor, a plough movable along the guide means back and forth along the mineral face, cutters on the plough for stripping mineral from the face during the movement of the plough, roof support units disposed at the goaf side of the conveyor, shifting rams connected to the roof-support units to alternately advance the conveyor and the units towards the mineral face, each support unit having at least one roof engaging member carried by at least one hydraulic prop, carriers connected to the roof engaging members, high-pressure water nozzles for emitting jets of high-pressure water supported by the carriers, the high-pressure water jets serving to produce a channel at the roof zone of the mineral face and further high-pressure water nozzles for emitting further jets of high-pressure water serving to produce a further channel at the floor zone of the mineral face, said further nozzles being carried on carrier means separate from the plough.

13. A mineral mining installation comprising a scraper-chain conveyor arranged in a mine working alongside a mineral face, guide means, a mineral winning machine equipped with cutters and movable along the guide means and conveyor to detach mineral from the mineral face with the aid of said cutters, roof supports arranged at the side of the conveyor remote from the mineral face, high-pressure fluid nozzles for emitting high-pressure fluid jets capable of producing at least one channel in the mineral face in a zone thereof outside that which is acted on by the cutters of the winning machine, and mechanical carrier means for supporting said nozzles in close vicinity to the mineral face for direct local impingement of the fluid jets thereon and for rendering said nozzles displaceable in relation to the mineral face, said carrier means being connected with part of the installation independent of the machine and the guide means.

* * * * *